US006430955B1

(12) United States Patent
Moretti et al.

(10) Patent No.: US 6,430,955 B1
(45) Date of Patent: Aug. 13, 2002

(54) CONDENSATE REMOVAL SYSTEM

(75) Inventors: Stephen L. Moretti, Auburn; Raymond J. Swidowski, Pennelville; Lou David Scrimale, Camillus, all of NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/858,701

(22) Filed: May 16, 2001

(51) Int. Cl.[7] ..... F25B 47/00
(52) U.S. Cl. ..... 62/279; 62/280
(58) Field of Search ..... 62/279, 280, 282, 62/285, 291, 262

(56) References Cited

U.S. PATENT DOCUMENTS 4,553,405 A 11/1985 Napolitano et al.
5,437,164 A * 8/1995 Consiglio ..... 62/285 X
6,067,812 A 5/2000 Bushnell et al.
6,085,539 A * 7/2000 Meyer ..... 62/285

FOREIGN PATENT DOCUMENTS

WO WO-00/73710 A1 * 12/2000

* cited by examiner

*Primary Examiner*—Chen-Wen Jiang
(74) *Attorney, Agent, or Firm*—Wall Marjama & Bilinski LLP

(57) ABSTRACT

Apparatus for distributing condensate over an outdoor heat exchanger of an air conditioner unit wherein the outdoor heat exchanger and an outdoor fan are enclosed within a housing. An orifice is located in the bottom of the housing adjacent to the fan and condensate produced in the unit is brought to the entrance of the orifice. The orifice is connected to a reservoir that directs condensate passing through the orifice to a point beneath the outdoor fan where the condensate can be picked by the fan and distributed over the heat exchanger surfaces. The size and shape of the orifice is matched to the pressure differential produced over the fan so that condensate is drawn rapidly into the housing and distributed by the fan over the outdoor heat exchanger.

8 Claims, 5 Drawing Sheets

CONDENSATE REMOVAL SYSTEM

BACKGROUND OF THE INVENTION

This invention relates to a packaged terminal air conditioner and, in particular, to apparatus for distributing condensate produced by the indoor evaporator over the surface of an condenser.

In U.S. Pat. No. 6,067,812 to Bushnell et al., a window air conditioning unit is described in which the indoor section of the unit is separated from the outdoor section by a dividing partition. Each section contains a heat exchanger and a fan for moving air over the heat exchanger surfaces. The indoor heat exchanger serves as an evaporator and the outdoor unit serves as a condenser. As explained in this patent, condensate produced by the evaporator is brought under the influence of the outdoor fan which, in turn, distributes the condensate over the outdoor heat exchanger to enhance the efficiency of the condenser.

The outdoor fan and the outdoor heat exchanger described in the Bushnell patent both are enclosed within a housing. The housing has a circular opening in a front wall adjacent the fan through which air is drawn in to the housing. A restricted passage is provided in the lower part of the housing through which condensate is permitted to enter the housing. The outdoor fan is provided with a slinger ring and is arranged to pick up the condensate that is drawn into the housing through the restricted passage. It has been found, however, that under certain operating conditions, condensate is prevented from entering the housing through the restrictive opening or the rate of flow through the opening is restricted.

BRIEF SUMMARY OF THE INVENTION

It is therefore an object of the present invention to improve air conditioning systems.

A further object of the present invention is to increase the efficiency of an air conditioning system by enhancing the distribution of condensate over the heat exchanger surfaces of the system evaporator coil.

A still further object of the present invention is to provide apparatus for promoting the free flow of condensate into a housing that encloses the outdoor fan and outdoor heat exchanger of an air conditioning system.

Another object of the present invention is to optimize the size and shape of an orifice for delivering condensate into a housing that encloses the outdoor fan and outdoor heat exchanger of an air conditioning system.

These and other objects of the present invention are attained in an air conditioning system having an indoor section containing a fan and a heat exchanger and an outdoor section also containing a fan and a heat exchanger. The unit includes a housing which encloses both the outdoor fan and the outdoor heat exchanger. The housing includes a front wall that is located adjacent to the outdoor fan. The front wall contains a circular opening through which air is drawn into the unit and distributed over the outdoor heat exchanger surface. An orifice is located in the lower part of the front wall and a flow channel is arranged to bring condensate to the entrance of the orifice. The size and shape of the orifice is matched to the pressure differential over the fan so that it is quickly drawn into the housing. A reservoir is located behind the orifice that serves to deliver the condensate to a point under the fan so that the condensate is picked up by the slinger and distributed over the heat exchanger.

BRIEF DESCRIPTION OF THE DRAWINGS

For a better understanding of these and other objects of the invention, reference will be made to the following detailed description of the invention which is to be read in association with the accompanying drawing, wherein.

DETAILED DESCRIPTION OF THE INVENTION

Figure 1:
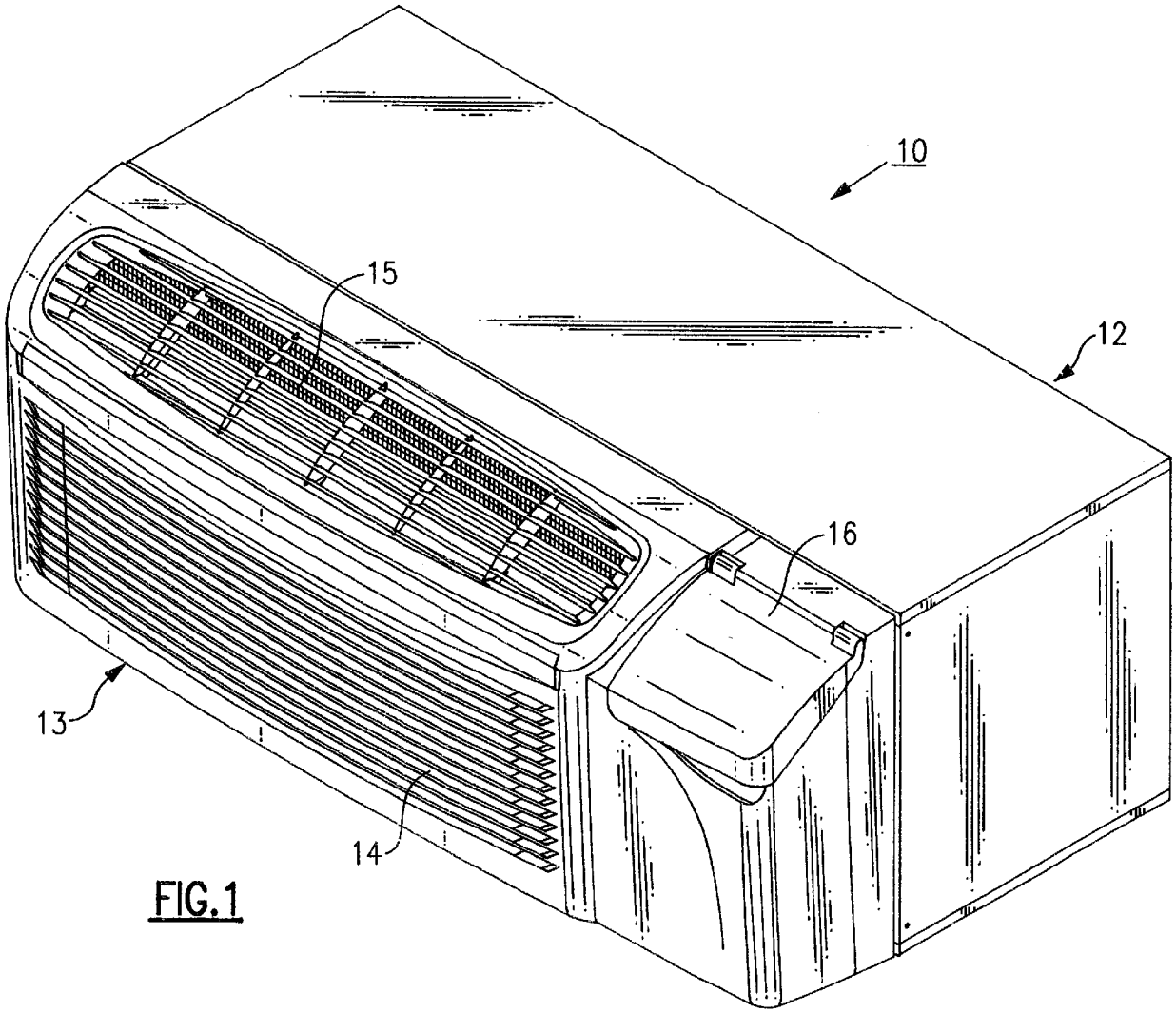
FIG. 1 is a perspective view of an air conditioning unit embodying the teachings of the present invention.

Referring initially to FIG. 1, there is illustrated a packaged terminal air conditioning unit, generally referenced 10, that embodies the teachings of the present invention. The unit is housed within a shell 12 that typically is mounted in an outside wall of a building in which the comfort area or room that is being serviced by the unit is situated. The unit is separated into an indoor section and an outdoor section by a dividing wall. Each section includes a heat exchanger and a fan for moving air over the surfaces of the heat exchanger. The front section of the unit is enclosed within a removable front cover 13 that is arranged to close against the front of the shell. The front cover further includes a lower opening 14 through which return air from the comfort area is drawn into the unit and an upper opening 15 through which conditioned air is returned to the comfort area. The controls for the unit are contained in the front section behind the front cover and access to the controls is gained through a hinged door 16.

Figure 2:
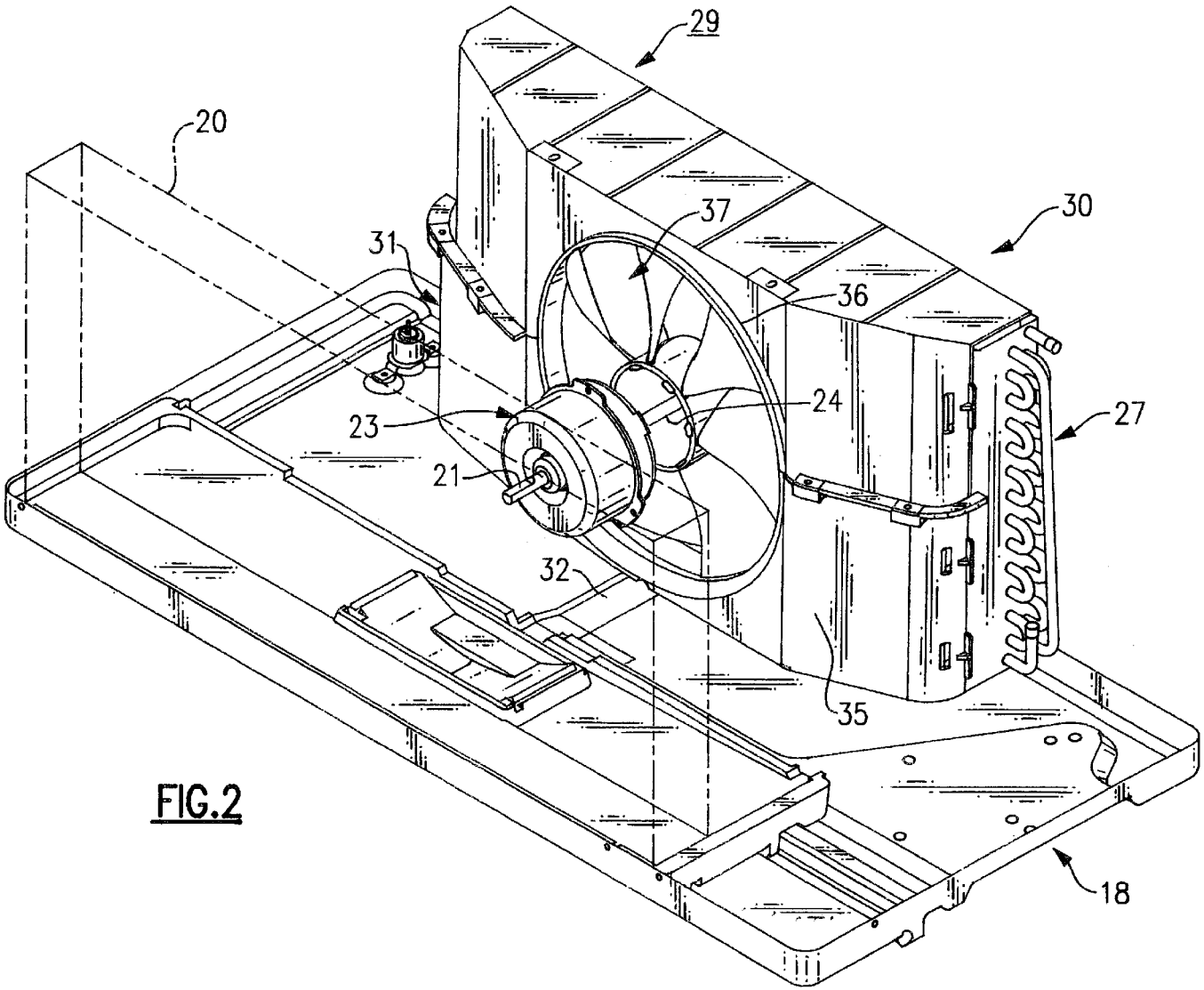
FIG. 2 is a further perspective view of the unit illustrated in FIG. 1 with portions broken away to show the housing that encloses the outdoor section of the unit in greater detail.

Turning now to FIG. 2, there is shown the unit base pan 18 upon which the component parts of the unit are mounted. The indoor heat exchanger 20 is shown in phantom outline located at the front of the base pan. Although not shown the indoor fan is mounted upon front drive shaft 21 of motor 23. The motor also has a rear drive shaft 24 that is adapted to drive the outdoor fan 37. The outdoor fan and the outdoor heat exchanger 27 are both enclosed in a two part housing 29 that includes an upper section 30 that is mounted on top of lower section 31.

Condensate that is produced by the indoor coil is routed via gravity into a channel 32 that is generally aligned with the axial center line of the motor. The channel, in turn, brings the condensate directly to the entrance to an orifice located in the bottom of the lower section of the housing which will be described in greater detail below. The front wall 35 of the housing contains a circular opening 36 having an inturned rim that acts as a stationary inlet shroud 37 with regard to outdoor fan 38. The fan serves to draw air into the housing through the opening 36 and distribute the air over the outdoor heat exchanger surfaces. The fan contains propeller-like blades that produce a pressure differential over the fan such that an area of relatively low pressure is produced on the suction side of the fan and an area of higher pressure is produced on the discharge side of the fan.

Figure 3:
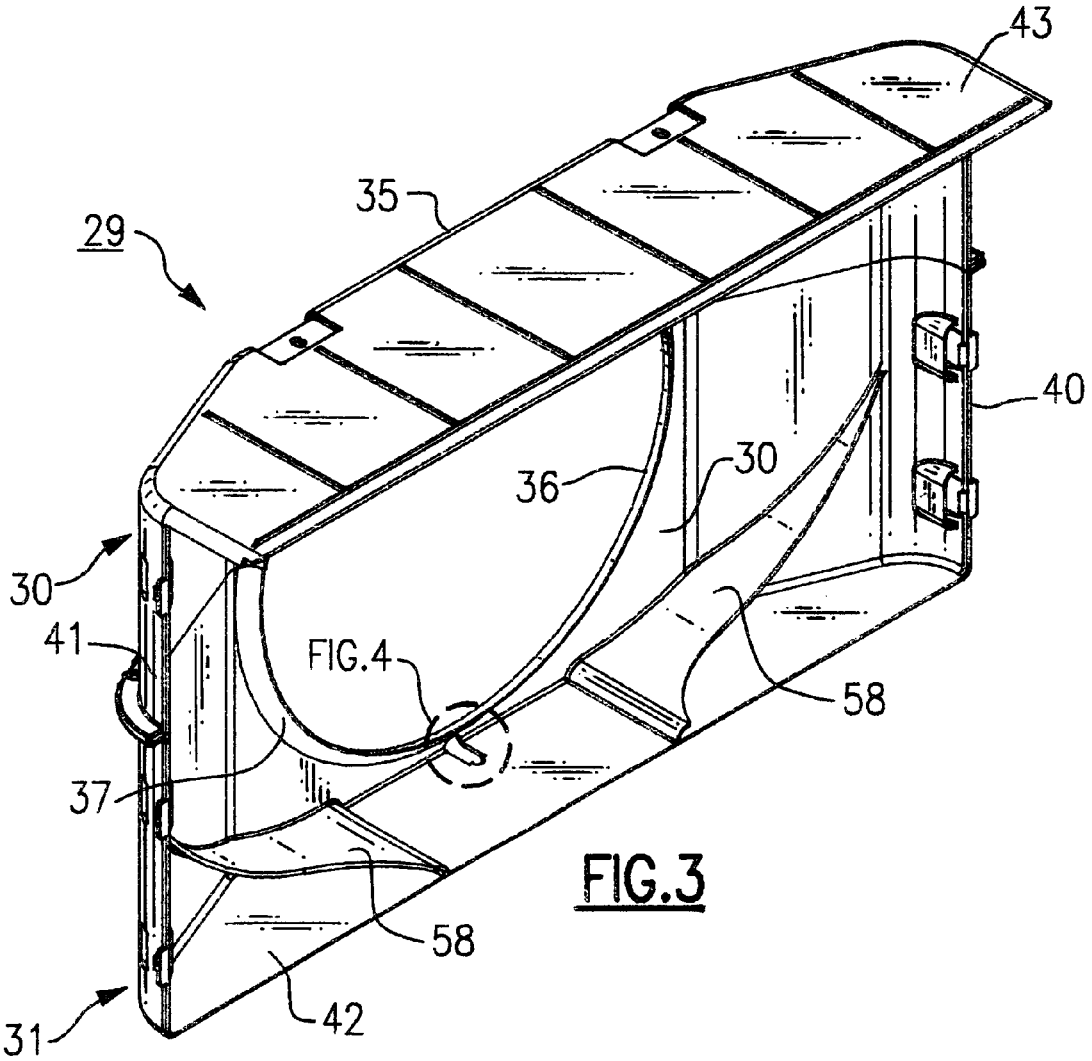
FIG. 3 is an enlarged rear perspective view of the housing.
Figure 4:
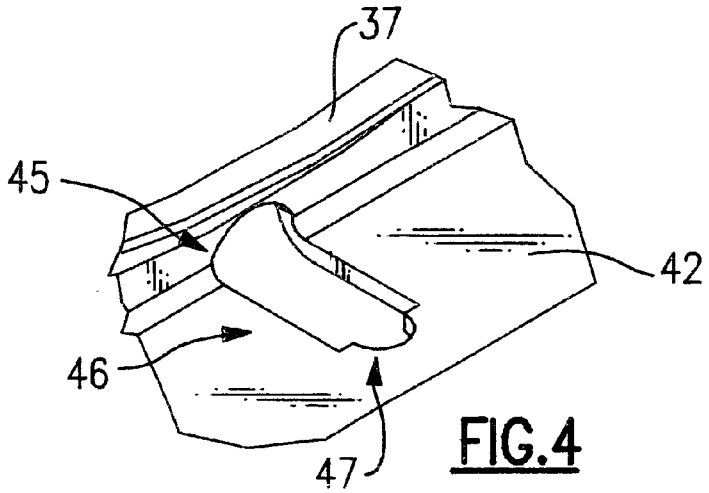
FIG. 4 is a further enlarged perspective view illustrating the orifice and reservoir for delivering condensate to the outdoor fan.
Figure 5:
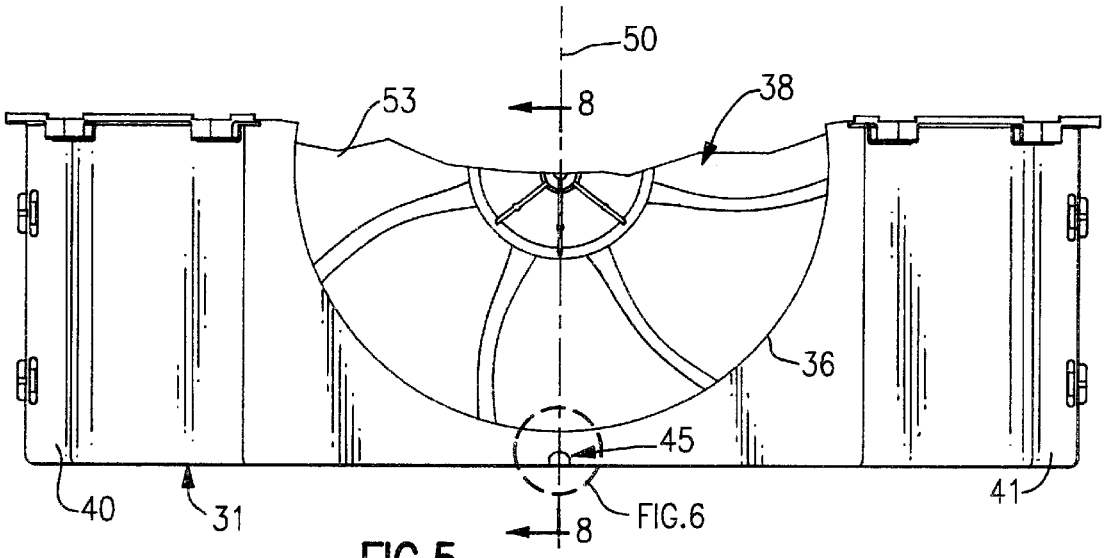
FIG. 5 is an enlarged partial front elevation illustrating the lower section of the housing.

FIG. 3 is a rear view of the housing 29 better illustrating the interior of the housing. The front wall 35 of the housing is joined to a pair of side walls 40 and 41 and the three walls coact with a bottom wall 42 and a top wall 43 to establish an open back unit that is capable of enclosing the outdoor fan and heat exchanger. As further illustrated in FIG. 4, the orifice 45 is passed through the bottom part of the front wall in the lower housing section. The orifice, in turn, communicates directly with a rectangular shaped reservoir 46 that is cut back through the bottom wall of the housing. A semi-circular metering basin 47 is formed in the back wall of the reservoir. As shown in FIG. 5, the orifice and the reservoir are centered upon the vertical axis 50 of the fan. However, the orifice and the reservoir can be slightly offset to either side of the vertical axis without adversely effecting the operation of the system.

Figure 8:
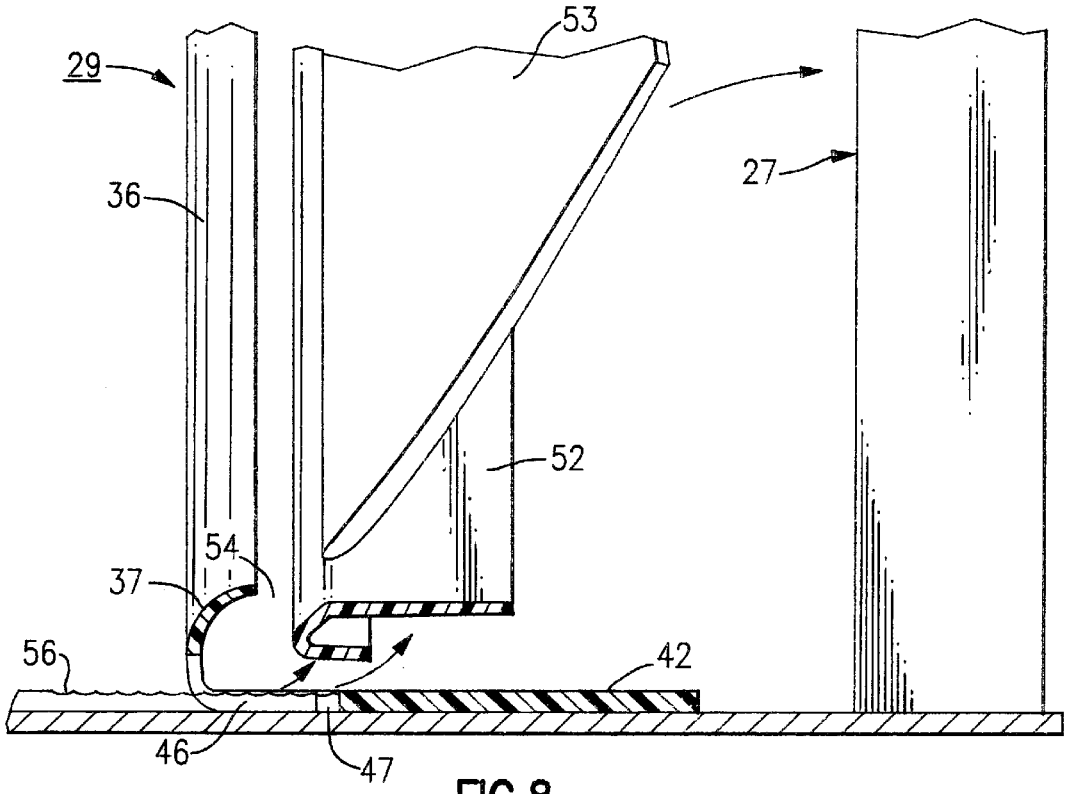
FIG. 8 is an enlarged sectional view taken along lines 8—8 in FIG. 5.

As illustrated in FIG. 8, a movable circular shroud or "slinger" ring 52 is secured to the blades 53 of the outdoor fan 38. The slinger ring is generally a J-shaped member that is arranged to sweep over the back of the condensate reservoir as the fan is turned by the fan motor 23. The slinger ring and the stationary shroud 37 that surrounds the air inlet opening 36 in the front wall of the housing 29 establish a narrow gap 54 separating the suction side and the discharge side of the fan. Accordingly, the entrance to the orifice is subjected to the suction side pressure while the bak side of the reservoir is subjected to the discharge side pressure. Condensate 56 that is delivered via gravity to the entrance of the orifice is quickly pulled into the housing and fills the reservoir area beneath the slinger ring. Here the condensate is exposed to the discharge side pressure and is picked up by the fan and distributed along with cooling air over the indoor heat exchanger surfaces. The inside of the housing is equipped with vanes 58 (FIG. 3) positioned to aid in the distribution of the air and water across the heat exchanger. The semicircular metering basin 47 in the back of the reservoir is positioned immediately beneath the slinger ring and serves to regulate the amount of water made available to the fan in this particular region.

Through experimentation, applicant' have found that the size and shape of the orifice is important to insure efficient passage of condensate into the housing when the outdoor fan is turning at operational speed. In the event the orifice is overly large, the orifice becomes subjected to the higher discharge pressure within the housing and condensate that is brought to the orifice entrance is blown back by the high pressure away from the orifice. If the orifice, on the other hand, is overly small, the orifice acts as a barrier to block the efficient flow of condensate into the housing. Through experimentation, the optimum size orifice can be found wherein condensate that is brought to the entrance of the orifice is exposed to the low pressure side of the fan and thus, rapidly drawn into the housing where it is picked up by the fan and distributed over the outdoor heat exchanger.

Figure 6:
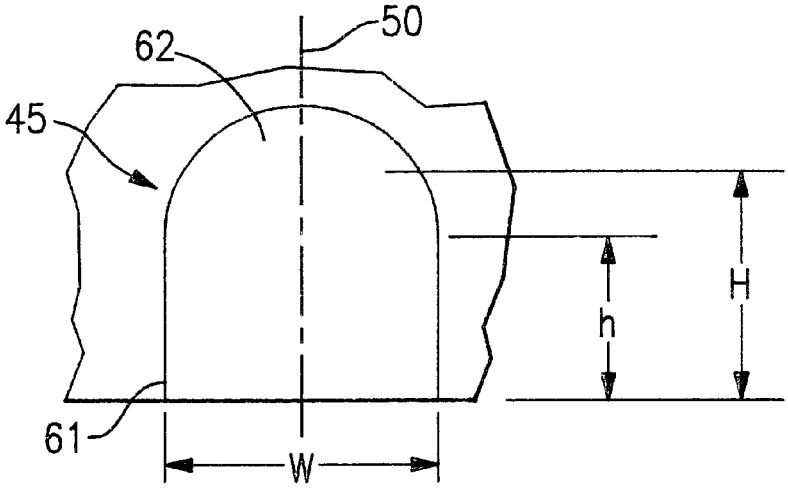
FIG. 6 is a further enlarged partial elevation showing the entrance to the orifice in greater detail.

It has been further determined through experimentation, that the shape of the orifice is also important in maintaining an optimum flow of condensate into the housing. An orifice having a shape similar to that shown in FIG. 6 has been found to perform efficiently used in association with a heat exchanger and fan housing similar to that shown in FIG. 2. The orifice 45, as illustrated, has a rectangular lower section 61 and an arcuate or dome shaped upper section 62. The width W of the orifice is preferably about twice that of the height h of the lower section. In addition, it is preferred that the height h of the lower section should also be about between 0.70 and 0.80 that of the overall height H of the orifice.

Figure 7:
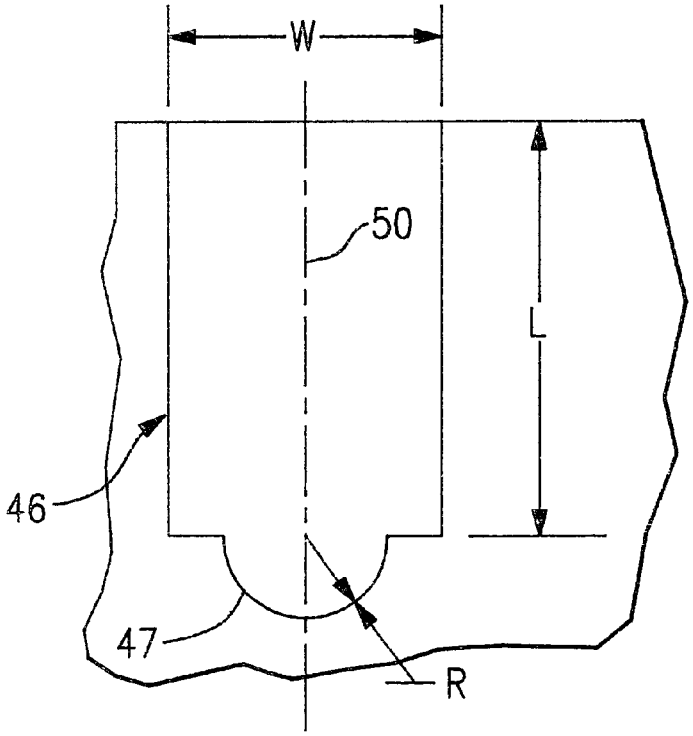
FIG. 7 is an enlarged partial top view of the reservoir located inside the housing behind the orifice.

The reservoir that services the orifice is constructed by simply cutting away the bottom wall of the housing 29 to the shape depicted in FIG. 7. The bottom wall of the housing is seated upon the floor of the base pan which, in assembly, now forms the floor of the reservoir. With further reference to FIG. 7, the main body of the reservoir is generally rectangular in form and has a width W that is substantially equal to the width of the lower section of the orifice. The length L of the reservoir is preferably between 1.5 and 1.6 times its width. The smaller semi-circular metering basin 47 that is located at the back of the reservoir has a radius R that is preferably between 0.6 and 0.70 the width W of the reservoir. Both the orifice and the reservoir are symmetrically aligned about the center line 50 of the fan.

While this invention has been explained with reference to the structure disclosed herein, it is not confined to the details set forth and this invention is intended to cover any modifications and changes as may come within the scope of the following claims:

What is claimed is:

1. In an air conditioning unit having an outdoor section separated from an indoor section by a divider and each section containing a heat exchanger and a fan for moving air over the heat exchanger, apparatus for distributing condensate produced by the indoor heat exchanger over the outdoor heat exchanger surfaces that includes:

a housing for enclosing the outdoor fan and outdoor heat exchanger;

said housing having a front wall that is adjacent to the outdoor fan and an opening through which air is drawn into the housing by said fan and distributed over the outdoor heat exchanger wherein a pressure differential is produced over the fan;

an orifice located in the bottom of said front wall wherein the orifice is in the pressure differential zone of the outdoor fan;

means for bringing condensate to the entrance of the orifice;

said orifice having a shape and an area that is matched to the pressure produced by the outdoor fan on said orifice so that condensate at the entrance to said orifice is drawn into the housing and distributed by the fan over the outdoor heat exchanger surfaces and said orifice includes a rectangular lower section and an arcuate upper section, said sections being symmetrically aligned on either side of a vertical centerline.

2. The apparatus of claim 1 wherein said housing contains a reservoir that extends rearwardly from said orifice into a region beneath said outdoor fan wherein condensate in said reservoir is drawn into the fan and distributed over said outdoor heat exchanger.

3. The apparatus of claim 2 wherein said outdoor fan has a slinger ring encircling the fan blades to enhance the distribution of said condensate.

4. The apparatus of claim 3 wherein said reservoir further includes a metering basin located beneath the slinger ring for regulating the distribution of condensate over the outdoor heat exchanger.

5. The apparatus of claim 3 wherein said housing further includes a series of stationary vanes for directing condensate from the slinger ring over the outdoor heat exchanger.

6. The apparatus of claim 2 wherein said reservoir is generally rectangular in form and has a width equal to the width of said lower section of said orifice and a length that is about between 1.5 and 1.6 times its width.

7. The apparatus of claim 2 wherein the vertical centerline of said orifice is offset slightly to one side of a vertical axis of the outdoor fan.

8. The apparatus of claim 1 wherein the lower section of said orifice has a width that is about twice its height and the height of the bottom section of the orifice is about between 0.70 and 0.80 that of the overall height of said orifice.

* * * * *